US005494183A

United States Patent [19]

Sharp

[11] Patent Number: 5,494,183

[45] Date of Patent: Feb. 27, 1996

[54] DOUBLE WALL STORAGE TANK SYSTEMS HAVING AN INTERMITTENTLY BONDED WALL

[76] Inventor: Bruce R. Sharp, 126 Leland Way, Marco Island, Fla. 33937

[21] Appl. No.: 229,869

[22] Filed: Apr. 19, 1994

Related U.S. Application Data

[63] Continuation-in-part of Ser. No. 717,686, Jun. 19, 1991, Pat. No. 5,303,840, which is a continuation of Ser. No. 464,460, Jan. 12, 1990, abandoned.

[51] Int. Cl.[6] ..... B65D 25/34

[52] U.S. Cl. ..... 220/469; 220/565; 220/453; 220/445

[58] Field of Search ..... 220/469, 445, 220/447, 453, 565

[56] References Cited

U.S. PATENT DOCUMENTS

| | | | |
|---|---|---|---|
| 665,349 | 1/1901 | Sewall . | |
| 2,847,193 | 8/1958 | Carter | 220/445 |
| 4,739,659 | 4/1988 | Sharp | 220/445 |
| 4,869,386 | 9/1989 | Sharp | 220/469 |
| 4,913,310 | 4/1990 | Sharp | 220/445 |
| 4,923,081 | 5/1990 | Weaver et al. | 220/645 |
| 5,000,342 | 3/1991 | Sharp | 220/445 |
| 5,054,645 | 10/1991 | Sharp | 220/445 |
| 5,115,936 | 5/1992 | Bartlow | 220/445 |
| 5,143,244 | 9/1992 | Kauffman | 220/445 |

FOREIGN PATENT DOCUMENTS

| | | | |
|---|---|---|---|
| 1147089 | 4/1963 | Germany | 220/445 |

*Primary Examiner*—Stephen J. Castellano
*Attorney, Agent, or Firm*—Charles R. Wilson

[57] ABSTRACT

A double wall storage tank system has its walls bonded together in a defined intermittent manner. The storage tank system comprises a tank having a cylindrical-shaped main body and end walls at each end thereof. A continuous wall covers the tank and is bonded thereto in a defined, e.g. helical pattern. Unbonded wall portions between the bonded wall portions form flow channels extending the full length of the cylindrical-shaped main body of the tank such that leakage through any part of the tank or continuous wall is detectable.

25 Claims, 3 Drawing Sheets

DOUBLE WALL STORAGE TANK SYSTEMS HAVING AN INTERMITTENTLY BONDED WALL

This is a continuation-in-part of "Storage Tanks Having Strengthened Walls", Ser. No. 07/717,686, filed Jun. 19, 1991, now U.S. Pat. No. 5,303,840, which is a continuation of Ser. No. 07/464,460, filed Jan. 12, 1990, now abandoned.

This invention relates to double wall storage tank systems. More particularly, the invention relates to double wall storage tank systems with walls intermittently bonded together.

BACKGROUND OF THE INVENTION

Commercial and industrial liquids of all types are stored in underground and above ground storage tanks. The capacity of such tanks are at least 500 gallons liquid and typically are 10,000 to 50,000 gallons liquid. The tanks presently being sold are made of metal or a fibrous reinforced resinous material. The metal storage tanks are made of a heavy gauge steel and are cylindrical-shaped. They are normally wrapped or coated with a non-corrosive material. The fibrous reinforced resinous material underground storage tanks are usually ribbed for added strength. The above ground tanks which are generally vertically disposed do not have ribs. However, they are most preferably filament wound for strengthening purposes.

Regardless of the material used to make the underground storage tanks, the tanks must have sufficient wall strength to withstand internal and external weight forces. Increased wall thickness does increase wall strength, but also increases the cost of producing the tank and the added weight increases the cost of installing it. Clearly, any leakage from the tanks, whether due to a complete collapse, a rupture, a crack or a small hole can have a substantial impact on the environment or health of nearby residents.

A need for an underground storage tank which can safely hold a substantial amount of potentially dangerous liquid is well recognized. Double walled storage tanks have been suggested. Various new methods of building tanks have also been suggested in recently issued patents. Still more efficient and cost effective methods of making reliable storage tanks are needed. In accord with this continuing need, there has been developed a double wall storage tank system with walls bonded together and with leak detection capability. The tank systems are economically built and are installed with conventionally used equipment.

SUMMARY OF THE INVENTION

A double wall storage tank system has cylindrical-shaped walls bonded together in a defined pattern. A tank has a cylindrical-shaped main body and end caps at each end. A continuous wall covers the main body wall and is intermittently bonded to it in the defined pattern. The bonded wall portion of the continuous wall extends around the cylindrical-shaped main body to create unbonded wall portions therebetween. The areas under the unbonded wall portions form continuous flow channels extending substantially the full length of the main body. Added end caps are attached to the continuous wall. A closed space between the end caps is in communication with the continuous flow channels such that any leak through either the tank or the continuous wall will be detected.

DETAILED DESCRIPTION OF THE INVENTION

The double wall storage tank systems of this invention have as their essential components a tank and a continuous wall formed on the tank. The tank is made of fibrous reinforced resinous material or metal, e.g. steel. The continuous wall is formed either on the outside surface of the tank or on the inside surface of the tank. The components of the double wall storage tank systems are described in detail in the following paragraphs as are methods of producing the tank systems.

Figure 1:
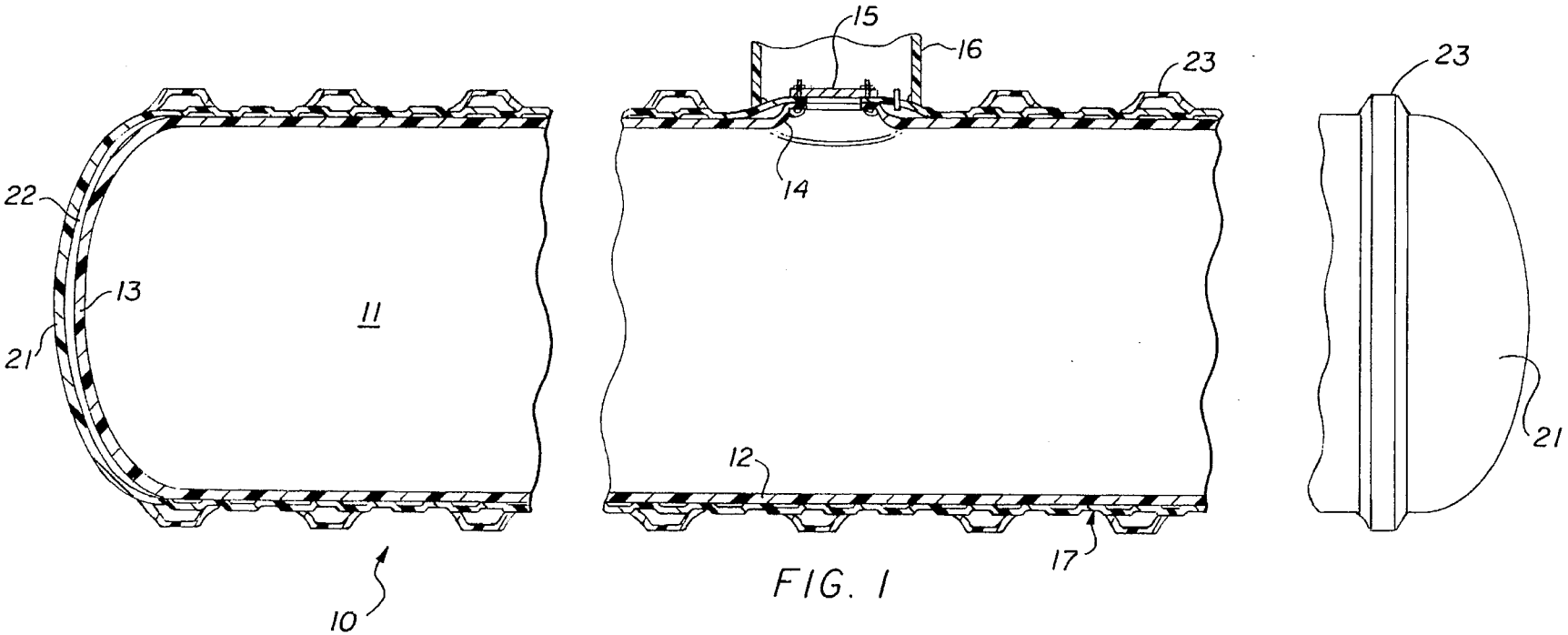
FIG. 1 is a side view partially in section of a double wall storage tank system of this invention

With reference to FIG. 1, there is shown a double wall storage tank system 10 of this invention. An inner storage tank 11 is comprised of a cylindrical-shaped main body wall 12, dome-shaped end walls 13, and a manway 14. The main body wall 12 and end walls 13 are made of a conventional fibrous reinforced resinous material. Not illustrated but within the spirit of this invention are those tanks wherein the end walls are flat and those tanks not having manways.

A sufficient number of openings are found in the storage tank 11 to allow for various access lines to the interior of the tank. For instance, a fill pipe, dispensing line and vent pipe can enter the storage tank at various points in the tank's surface, but preferably all enter through a cover 15 of the manway 14. A sleeve 16 which sits on the tank's top surface and encompasses the manway 14 can optionally be added to enclose this area for spill containment purposes.

Figure 2:
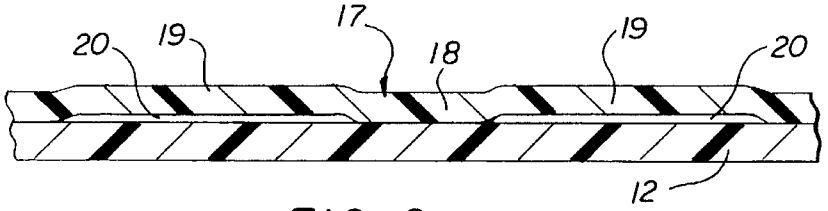
FIG. 2 is an enlarged partial sectional view showing a wall area of the storage tank system of FIG. 1.
Figure 3:
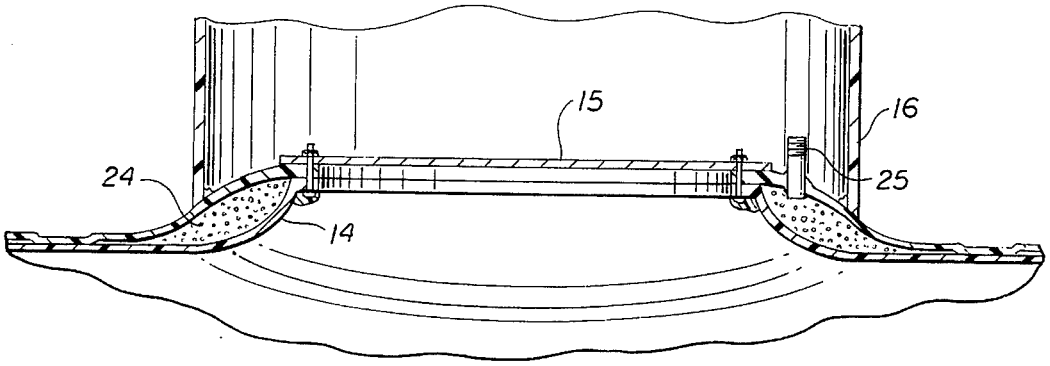
FIG. 3 is an enlarged sectional view of a manway and an access sleeve found on the double wall storage tank system of FIG. 1.
Figure 5:
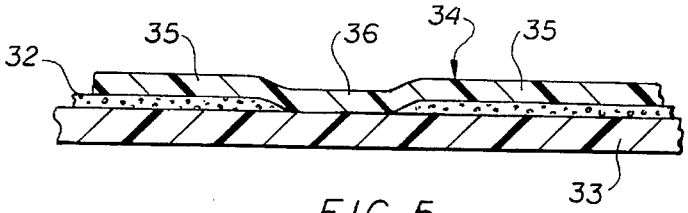
FIG. 5 is an enlarged sectional view showing a wall area of the double wall storage tank system of FIG. 4 taken along line 5—5 thereof.
Figure 6:
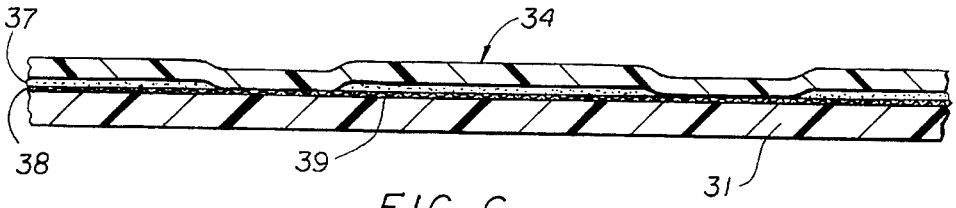
FIG. 6 is an enlarged sectional view of a wall area of the double wall storage tank system of FIG. 4 taken along line 6—6 thereof.

In accord with the embodiment of the invention shown in FIGS. 1–3, an outer continuous wall 17 is formed over the inner storage tank 11. The continuous wall is bonded in an intermittent pattern to the cylindrical-shaped main body wall 12 of the tank. As illustrated in FIG. 1, the portions 18 of the continuous wall 17 which are bonded to the tank form a helical pattern which extends around the tank and the full length thereof. The areas between the bonded areas are unbonded and, as most evident in FIG. 2, the overlying wall portions 19 create closed areas 20. The closed areas 20 form flow channels extending the full length of the cylindrical-shaped body. The flow channels having the depicted spiral pattern is highly preferred because of its continuous nature and its ease of manufacture. However, portions of the continuous wall can be bonded to the main body of the tank in other patterns including generally horizontally or vertically oriented patterns. As discussed in detail below, any leakage through the tank or the continuous wall will either find its way into the flow channel and migrate to a leak detection means or noticeably affect a level of leak detection liquid.

The continuous wall 17 comprising the bonded wall portions 18 and unbonded wall portions 19 extends less than about ½ inch in height from the main body wall 12, preferably from about 1/64 inch to about ¼ inch. Wall portions 19 overlying the closed areas 20 may contact the tank's main body wall 12. Such contact is not detrimental to the storage tank system's performance provided the two walls remain at least partially separated in this area i.e. they are not sealed together.

The width of the wall portions 18 where bonded to the cylindrical-shaped main body wall ranges from about one-fourth inches to about eighteen inches. The preferred width of a bonded wall portion is from about one-half inches to about one inch. About one-half inch to about eighteen inches, preferably about one inch to about three inches separate the individual bonded wall portions. The preferred widths and spacing varies based on structural design and size of the tank. The aforementioned preferred widths are for a storage tank having a diameter of from about four feet to about twelve feet. Most importantly, the widths of the bonded wall portions compared to the widths of the unbonded wall portions must be such that the resultant storage tank is still considered double walled by industry standards.

The continuous wall 17 of the double wall storage tank 10 of FIGS. 1–3 is made of a fibrous reinforced resinous material. Initially, areas of the tank which are to be covered, though unbonded to the continuous wall, are given a release coating to ensure the subsequently applied wall will not bond thereto. The materials of construction of the tank wall and the continuous wall determine the release material needed. For example, a wax applied in a helical pattern around the cylindrical-shaped main body will prevent a subsequently applied fibrous reinforced resin material from bonding. Once applied, the continuous wall is formed directly over the full main body of the tank. The wax is subsequently melted and optionally removed to break any bond thereto. Fibrous reinforcing materials and resinous materials which are conventionally used in forming known storage tanks are used. The fibrous reinforcing material can take on many different physical shapes and structures, variously referred to as mattings, nets, screens, meshes, continuous strands, and chopped strands. Examples of fibrous materials include fiberglass, nylon, and other synthetic fibrous materials. Several different resinous materials are known for the purpose of reinforcing fibrous material. Such materials include polyesters, e.g. vinylesters, isophthalic polyesters, polyurethanes, and polyepoxides. The listed resinous materials used in the construction of the continuous wall are not all inclusive, but only illustrative of some of the resinous materials which can be used.

The fibrous material, if in sheet form, is laid onto the storage tank as a continuous matting. Once the fibrous reinforcing material is applied, the resinous material is next applied to the reinforcing material and thereafter cured. If more wall thickness is desired additional resinous material and fibrous reinforcing material may be applied until the desired wall thickness is reached.

Preferably, the fibrous material is applied in the form of chopped strands along with the resinous materials described in the previous paragraph. Thus, the chopped strand and resinous material are sprayed from separate sources of the same spray gun assembly and form the outer continuous wall as the resin cures. This application method is commonly known as applying fiberglass and resin with a chopper gun to form FRP (Fibrous Reinforced Plastic) lay-ups. Still another method of forming the outer continuous wall is by filament windings. In this method continuous reinforcing fibrous strands are impregnated with resinous material and then wrapped in a crossing pattern over the inner tank.

End caps 21 are added over the tank's end walls 13, after, before or during formation of the continuous wall 17 over the cylindrical-shaped main body wall of the tank. The added end caps are spaced from the tank to create a closed space 22. In the tank system of FIG. 1, the helical-shaped flow channel extending the length of the cylindrical-shaped main body is in communication with the closed spaces 22 between both sets of end caps. The end caps are an extension of the continuous wall such that a full outer tank is created, fully encasing the tank 11.

As evident in FIG. 1, a set of support ribs 23 are added to enhance the strength of the storage tank system. The support ribs are preferably uniformly spaced and extend circumferentially around the tank. They are bonded to the continuous wall 17, preferably on the unbonded wall portions 19 thereof. Besides adding strength, the support ribs also protect the continuous wall during shipping and installation. Any minor bumpings will be absorbed by the ribs with the liquid containment ability of the storage tank and continuous wall unaffected.

As best seen in FIG. 3, the manway 14 is integral with the cylindrical-shaped main body wall 12 of the tank 11. A separating material 24 is first positioned around the manway 14 and partially extending over the main body wall 12 to ensure that the continuous wall 17 is separated therefrom and when needed, form a reservoir area for use with leak detection liquid. An access opening 25 is also provided for this latter purpose. The continuous wall 17 extends to the terminus of the manway 14 to provide total secondary containment. It could as well extend to the manway's side wall. The cylindrical-shaped sleeve 16 is positioned over the manway and secured to the continuous wall. The sleeve provides access means to the cover 15 of the manway 14 in the event entry into the tank is required, e.g. for periodic inspection purposes.

The resultant double wall storage tank system has a number of advantages. The basic inner storage tank has substantially increased strength due to the closely spaced continuous outer wall. The very nature of the continuous wall at least in the unbonded areas allows a minimal degree of movement without cracking or collapsing. Cracking in one wall in most cases will not be transmitted to the other wall. In fact, the bonded areas are designed to shear away from each other and/or crack only up to a flow channel. This feature means that even a wall failure in a bonded area will be detected as further discussed below.

It is even possible with this invention to use an inner storage tank with a less than normal wall thickness because of the added strength provided by the bonding of the walls together. This feature translates into a reduced tank cost. True secondary containment of the liquid in the storage tank is most importantly provided. A further advantage stems from the relatively minimal volumetric area of the flow channel. Because it is minimal, leak detection liquid, including dyed liquids, can be added at the factory without a concern for significant added shipping weight. As such, any defective tank wall can be detected at the factory or at least prior to installation. All the above advantages are obtained without a substantial, if any, cost increase.

With references to FIGS. 4–7, another double wall storage tank system 30 of the invention is made with the use of a separating material. The inner storage tank 31 is the same as described above with reference to FIGS. 1–3. The separating material 32 is positioned in a helical pattern of prescribed width around the cylindrical-shaped main body wall 33 to create areas where a subsequently formed continuous wall 34 will not bond.

Separating materials include solid polymeric films, corrugated strips and foraminous or porous materials which are preferably sealed on at least one side. Many pliable or semi-rigid materials are usable. Examples of such material are polyethylene, jute, polyurethane foam, polyester foam, polyether foam, fiberglass matting, cotton matting, nylon matting, corrugated cardboard, waxed surface paper and other fibrous sheets which range from about 0.01 inches to almost ½ inch in thickness. A heat seal or sealing material, e.g. a polymeric coating, or a impervious wrapping such as polyethylene sheeting is used on one surface of any foraminous or porous materials when needed to prevent substantial saturation with a subsequently applied resinous material.

The thickness of the separating material must be sufficient to prevent the subsequently applied overlying portions of the continuous wall from adhering to the tank. Accordingly, any shrinkage resulting from formation of the continuous wall must be accounted for by having a sealed material that can partially collapse or compress, but not form a compression seal between the walls so as to restrict flow.

Figure 7:
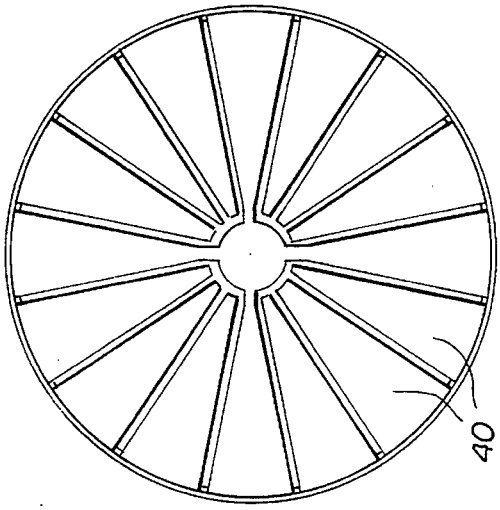
FIG. 7 is an end view of the double wall storage tank system of FIG. 4.
Figure 4:
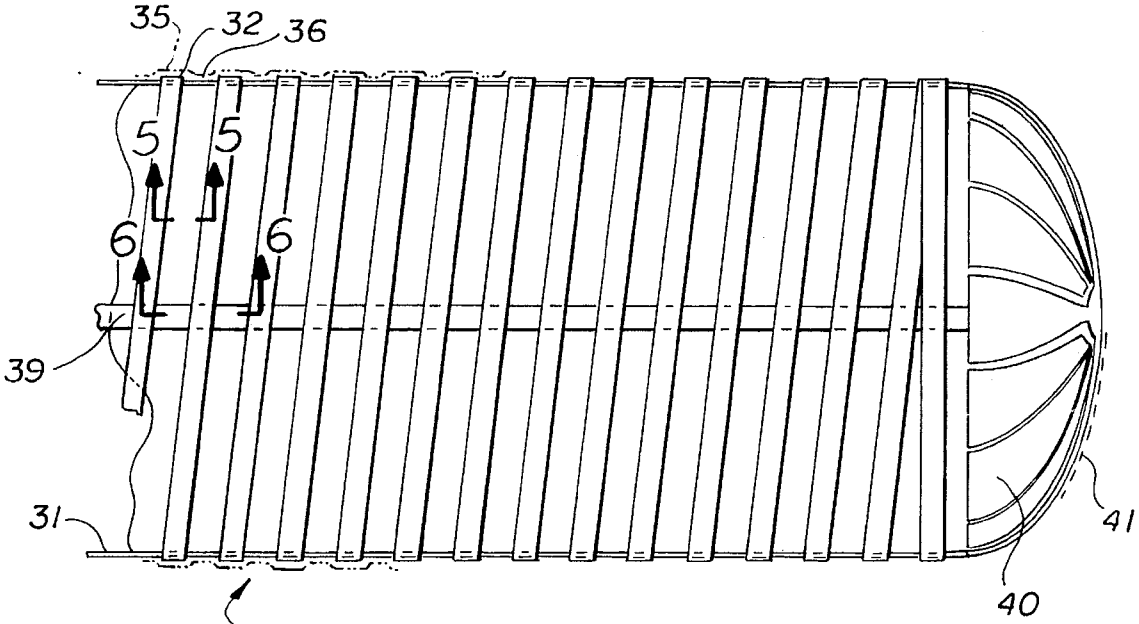
FIG. 4 is a partial side view of another double wall storage tank system of the invention showing a spacing material used in formation of an outer continuous wall.

The continuous wall 34 has unbonded wall portions 35 overlying the separating material 32 and bonded wall portions 36. The wall portions 35 not bonded to the tank 31 forms a continuous flow channel 37 extending the full length of the main body of the tank and is in communication with the closed areas formed in the end cap areas. To ensure communication, an intersecting cross flow channel 38 is provided on the tank system by initially positioning at least one horizontal strip of separating material 39 along the main body wall 33 of the tank the full length thereof. As evident in FIG. 6, the horizontal cross flow channel 38 and the helical-shaped continuous flow channel 37 intersect and are in communication. The cross flow channel can and preferably does communicate with the flow channels 40 in the end cap areas 41 as seen in FIG. 7.

While not illustrated, other defined patterns along the tank wall can be used. For example, a sinusoidal-shaped pattern or a generally horizontally disposed pattern can be used, though require more labor and, for this reason, are less preferred. Particularly important in this regard, the top portion of the cylindrical-shaped main body of the tank can be fully bonded or the continuous wall can cover only the lower portion of the tank, i.e. provide about 300 degrees to about 340 degrees coverage. The single wall top center-line area is used for piping accesses.

Any of well know and commercially available monitor means are used for monitoring the closed spaces of the flow channel. For example, the closed space can be placed either under a non-atmospheric pressure, i.e. a positive or negative air pressure. Pressures of 3 psi or greater, e.g. even 100 psi dependent on bonding spacing can be used without concern for wall or tank rupture. Detection means associated with the closed space is capable of detecting any change in pressure resulting from a leak in the continuous wall or the storage tank. Thus, there can be provided a means for maintaining the closed space under a negative pressure. A conventional vacuum pump, together with an associated pressure regulator can be used. A pressure change sensor is a part of the detection means. A pressure gauge serves this purpose adequately. Optionally, an alarm system can be electronically linked with the pressure sensor to audibly or visually warn of a preset significant pressure change.

Another embodiment of the detection means utilizes an analyzer capable of detecting the liquid being stored. Thus, the detection means comprises the analyzer which is communication with the closed annular spaces. Preferably, a vacuum means for withdrawing gaseous material from the closed spaces is used for the purpose of obtaining a sample.

Still another detection means utilizes a probe to monitor for leakage. The probe is capable of detecting preselected liquids or gases. In this embodiment, leakage will ultimately seep to the bottom of the closed spaces and be detected.

Detecting liquid can also be used as part of a detection means. Thus, preferably a non-freezing liquid is used to fill the flow channel and an access tube is installed leading to ground level or above. A sight glass at the access tube's end allows a visual observation of any change in detecting liquid level. Additionally, a dyed leak detection liquid can be added at the factory prior to field installation for an early indication of any manufacturing flaws.

All the leak detection means discussed above can be electronically linked with an alarm system to audibly or visually warn of a pre-set significant change in any of the closed annular spaces. The leak detection means and secondary containment means allow for an early warning of a deterioration of either the primary storage tank or the continuous wall thereby permitting the necessary repair work to be done before any significant soil or water contamination has occurred.

While the invention has been described with respect to preferred embodiments, it is understood that various modifications may be made without departing from the spirit of the subject invention as defined by the appended claims. For example, above ground storage tanks which are vertically disposed with substantially flat bottom walls and covered tops can be modified in accord with this invention. All obvious variations are considered within the scope of the appended claims.

I claim:

1. A double wall storage tank system having cylindrical-shaped walls structurally bonded together in a defined intermittent manner whereby flow channels are created to receive leaked liquid, said system comprising:

(a) a tank having a cylindrical-shaped main body and having an end wall attached at each end thereof, said tank having a capacity of at least about 500 gallons liquid; and (b) a cylindrical-shaped continuous wall which covers the cylindrical-shaped main body of the tank so as to extend less than about one-half inch in height from the tank and which is intermittently bonded thereto in a defined pattern, whereby said pattern extends at least partially about said cylindrical-shaped main body to create unbonded wall portions between the bonded wall portions thereby forming flow channels extending substantially the full length of the cylindrical-shaped main body such that leaked liquid through the tank or the continuous wall is capable of being detected.

2. The double wall storage tank system of claim 1 further comprising added end caps which are structurally secured to the continuous wall to form an enclosed structure which substantially follows the contour of the main body of the tank.

3. The double wall storage tank system of claim 2 further wherein the flow channels formed between the tank and the continuous wall are in communication with the closed space between each end wall of the storage tank and each end cap of the continuous wall.

4. The double wall storage tank system of claim 3 wherein each end cap of the continuous wall is structurally bonded to each end wall of the main body of the tank in an intermittent manner to create flow channels, at least one of which is in communication with the flow channels which extend substantially the full length of the cylindrical-shaped main body.

5. The double wall storage tank system of claim 1 wherein the continuous wall is on an outside wall of the main body of the tank.

6. The double wall storage tank system of claim 5 further wherein a set of circumferentially extending support ribs are bonded onto the continuous wall to enhance the strength of the system.

7. The double wall storage tank system of claim 1 wherein the continuous wall is on an inside wall of the tank.

8. The double wall storage tank system of claim 1 wherein the defined pattern is a helical pattern.

9. The double wall storage tank system of claim 1 wherein each of the bonded wall portions of the continuous wall is from about one-fourth inch to about eighteen inches in width.

10. The double wall storage tank system of claim 9 wherein each of the bonded wall portions of the continuous wall is from about one-half inch to about one inch in width and are spaced from about one inch to about three inches apart.

11. The double wall storage tank system of claim 1 wherein the continuous wall extends less than about one-half inch in height from the tank.

12. A double wall storage tank system having cylindrical-shaped walls structurally bonded together in a defined intermittent manner whereby flow channels are created to receive leaked liquid, said system comprising:

(a) a tank having a cylindrical-shaped main body and having an end wall attached at each end thereof; and (b) a cylindrical-shaped continuous wall of a fibrous reinforced resinous material which covers the cylindrical-shaped main body of the tank and which is intermittently bonded thereto in a defined pattern, whereby said pattern extends at least partially about said cylindrical-shaped main body to create unbonded wall portions between the bonded wall portions thereby forming flow channels of a continuous nature extending substantially the full length of the cylindrical-shaped main body such that leaked liquid through the tank or the continuous wall is capable of being detected; and (c) an end cap over each end wall of the tank to create a closed space therebetween, each said end cap being structurally secured to the continuous wall so as to form an enclosed structure which substantially follows the contour of the main body of the tank, whereby the flow channels formed between the tank and the continuous wall are in communication with each said closed space wherein each of the bonded wall portions of the continuous wall is from about one-half inch to about one inch in width and said bonded wall portions are spaced from about one inch to about three inches apart.

13. The double wall storage tank system of claim 12 wherein the continuous wall extends less than about one-half inch in height from the main body of the tank.

14. The double wall storage tank system of claim 12 wherein each end cap of the continuous wall is structurally bonded to each end wall of the main body of the tank in an intermittent manner to create flow channels, at least one of which is in communication with the continuous flow channels which extend substantially the full length of the cylindrical-shaped main body.

15. The double wall storage tank system of claim 12 wherein the defined pattern is a helical pattern.

16. A double wall storage tank system having cylindrical-shaped walls structurally bonded together in an intermittent manner whereby a helical flow channel is created to receive leaked liquid, said system comprising:

(a) a tank having a cylindrical-shaped main body and having an end wall attached at each end thereof, said tank having a capacity of at least about 500 gallons liquid; and (b) a cylindrical-shaped continuous wall which covers the cylindrical-shaped main body of the tank and which is intermittently bonded thereto in a helical pattern, whereby said helical pattern extends about said cylindrical-shaped main body to create unbonded wall portions between the bonded wall portions thereby forming the helical flow channel extending substantially the full length of the cylindrical-shaped main body such that leaked liquid through the tank or the continuous wall is capable of being detected.

17. The double wall storage tank system of claim 16 further comprising an end cap over each of the end walls to create closed spaces, each said end cap being structurally secured to the continuous wall so as to form an enclosed structure which substantially follows the contour of the main body of the tank.

18. The double wall storage tank system of claim 17 further wherein the helical flow channel formed between the tank and the continuous wall is in communication with the closed space between each end wall of the tank and each end cap.

19. The double wall storage tank system of claim 18 wherein each end cap of the continuous wall is structurally bonded to each end wall of the main body of the tank in an intermittent manner to create flow channels, at least one of which is in communication with the helical flow channel which extends substantially the full length of the cylindrical-shaped main body.

20. The double wall storage tank system of claim 16 wherein the continuous wall is intermittently bonded to an outside wall of the main body of the tank.

21. The double wall storage tank system of claim 16 wherein the continuous wall is intermittently bonded to an inside wall of the main body of the tank.

22. The double wall storage tank system of claim 16 wherein each of the bonded wall portions of the continuous wall is from about one-fourth inch to about eighteen inches in width.

23. The double wall storage tank system of claim 22 wherein each of the bonded wall portions of the continuous wall is from about one-half inch to about one inch in width and are spaced from about one inch to about three inches apart.

24. The double wall storage tank system of claim 16 wherein the continuous wall extends less than about one-half inch in height from the main body of the tank.

25. The double wall storage tank system of claim 16 further comprising a horizontal cross flow channel extending across the main body of the tank so as to intersect the helical flow channel and be in communication therewith.

* * * * *